US010005601B2

(12) United States Patent
Wang et al.

(10) Patent No.: US 10,005,601 B2
(45) Date of Patent: Jun. 26, 2018

(54) PACKAGING CASE

(71) Applicant: Yuhua Wang, Beijing (CN)

(72) Inventors: Yuhua Wang, Beijing (CN); Chung Yi Nicole Chai, Hong Kong (CN)

( * ) Notice: Subject to any disclaimer, the term of this patent is extended or adjusted under 35 U.S.C. 154(b) by 7 days.

(21) Appl. No.: 15/024,843

(22) PCT Filed: Sep. 29, 2014

(86) PCT No.: PCT/CN2014/087783
§ 371 (c)(1),
(2) Date: Mar. 24, 2016

(87) PCT Pub. No.: WO2015/051724
PCT Pub. Date: Apr. 16, 2015

(65) Prior Publication Data

US 2016/0236843 A1 Aug. 18, 2016

(30) Foreign Application Priority Data

Oct. 8, 2013 (CN) ..... 2013 2 0613140 U

(51) Int. Cl.
*B65D 6/00* (2006.01)
*B65D 75/38* (2006.01)
(Continued)

(52) U.S. Cl.
CPC ..... *B65D 75/38* (2013.01); *B65D 5/38* (2013.01); *B65D 5/4208* (2013.01); *B65D 65/16* (2013.01); *B65D 75/566* (2013.01); *B65D 85/70* (2013.01)

(58) Field of Classification Search
CPC ..... B65D 75/38; B65D 5/38
(Continued)

(56) References Cited

U.S. PATENT DOCUMENTS 1,957,293 A * 5/1934 Reilly ..... A24F 15/12 206/250
5,027,947 A * 7/1991 Reighart ..... B65D 11/12 206/335
(Continued)

FOREIGN PATENT DOCUMENTS

CN 201080274 Y 7/2008
CN 203186689 U 9/2013
(Continued)

OTHER PUBLICATIONS

ISR for PCT/CN2014/087783 dated Dec. 23, 2014 and its English translation by WIPO.
(Continued)

*Primary Examiner* — Steven A. Reynolds
*Assistant Examiner* — Javier A Pagan
(74) *Attorney, Agent, or Firm* — Ladas & Parry, LLP

(57) ABSTRACT

A packaging case suitable for packaging an elongated article (41) and being displayed in a shop or an exhibition hall is provided. The packaging case comprises: an inner case (3) able to accommodate the article (41) and an outer sleeve (4) capable of externally sheathing the inner case (3), wherein the inner case (3) can move back and forth into and out of the outer sleeve (4), the packaging case further comprises a flexible strip (10), one end of the strip (10) is fixed to an outer surface (12) of the inner case (3), the other end of the strip (10) is fixed to an inner surface (21) of the outer sleeve (4), and the outer surface (12) and the inner surface (21) are two surfaces which are opposed to each other and kept close to mutually when the inner case (3) is sheathed in the outer sleeve (4).

9 Claims, 3 Drawing Sheets

(51) Int. Cl.

| | |
|---|---|
| ***B65D 5/38*** | (2006.01) |
| ***B65D 5/42*** | (2006.01) |
| ***B65D 65/16*** | (2006.01) |
| ***B65D 75/56*** | (2006.01) |
| ***B65D 85/00*** | (2006.01) |

(58) Field of Classification Search
USPC ..... 220/8; 206/804, 267, 270, 252, 254
See application file for complete search history.

(56) References Cited

U.S. PATENT DOCUMENTS

| | | | | |
|---|---|---|---|---|
| 2006/0070896 | A1* | 4/2006 | Focke | B65D 5/38 206/248 |
| 2011/0139864 | A1* | 6/2011 | Wipf | B65D 5/38 229/122 |
| 2016/0101926 | A1* | 4/2016 | Tseng | B65D 85/18 206/8 |

FOREIGN PATENT DOCUMENTS

| | | | |
|---|---|---|---|
| CN | 203652233 | U | 6/2014 |
| DE | 2422148 | A1 | 11/1975 |
| GB | 116703 | A | 9/1918 |

OTHER PUBLICATIONS

Written Opinion for PCT/CN2014/087783 dated Dec. 23, 2014 and its English translation by Google Translate/OCR by Adobe Acrobat Pro.

* cited by examiner

PACKAGING CASE

CROSS-REFERENCE TO RELATED APPLICATIONS

This application is the U.S. National Stage of International Patent Application No. PCT/CN2014/087783 filed on Sep. 29, 2014, which claims the priority to Chinese Patent Application No. 201320613140.7 filed on Oct. 8, 2013, the disclosures of which are hereby incorporated in their entireties by reference.

FIELD OF THE INVENTION

The present invention relates to a packaging case. Particularly, the present invention relates to a packaging case suitable for packing an elongated article and being displayed in a shop or an exhibition hall.

BACKGROUND OF THE INVENTION

In present shops or exhibition halls, thousands of kinds of articles are packed and displayed in packaging cases. However, heretofore, there lacks a kind of packaging case which can perfectly show the articles to customers or visitors during display and can be retracted to its minimum volume during storage. The present invention provides such a kind of packaging case.

SUMMARY OF THE INVENTION

The aim of the present invention is to overcome the deficiency of the prior art and to provide a packaging case suitable for packing an elongated article and being displayed in a shop or an exhibition hall, said packaging case comprises an inner case capable of accommodating the article and an outer sleeve with a shape matching that of the inner case and capable of externally sheathing the inner case, the inner case being able to move back and forth into and out of the outer sleeve, wherein the packaging case further comprises a strip made of a flexible thin sheet material, one end of the strip is fixed to an outer surface of the inner case, the other end of the strip is fixed to an inner surface of the outer sleeve, said outer surface and said inner surface are two surfaces which are opposed to each other and kept close to mutually when the inner case is sheathed in the outer sleeve.

In the packaging case according to the present invention, a length of the strip and positions of the outer surface and the inner surface to which both ends of the strip are to be fixed are arranged so that: (1) when the inner case is sheathed into the outer sleeve, the whole packaging case has a minimum overall length; and (2) when the inner case is pulled out of the outer sleeve to an extreme, a portion of the inner case is still sheathed by the outer sleeve.

In the packaging case according to the present invention, at least one of both ends in a longitudinal direction of the outer sleeve is opened.

In the packaging case according to the present invention, a hanging hole for hanging the packaging case is provided on an end distant from the end which is opened of the outer sleeve.

In the packaging case according to the present invention, at least one surface of the inner case is made of a transparent material.

In the packaging case according to the present invention, the flexible thin sheet material of which the strip is made is a plastic sheet.

In the packaging case according to the present invention, the both ends of the strip are fixed to the outer surface of the inner case and the inner surface of the outer sleeve by adhesive bonding or molten plastics bonding.

In the packaging case according to the present invention, the inner case and the outer sleeve are made of a card board, a wood sheet, a plastic sheet or a glass plate.

In the packaging case according to the present invention, the elongated article to be packed in the packaging case is a wiper blade for a windshield of a car.

In the packaging case according to the present invention, the length of the strip in a longitudinal direction of the packaging case is adjustable.

The packaging case according to the present invention can satisfy the requirements of those engaged in the art: in a shop or exhibition hall, the packaging case can perfectly show the article to customers and visitors during display to maximize a commercial communication effect and can also retract to its minimum volume during storage to reduce cost of warehousing and transportation. Particularly, it is remarkably effective especially for elongated articles such as a wiper blade for a windshield of a car, a writing brush, a folding fan, etc. A further advantage of the packaging case according to the present invention is: in a shop, after a worker takes out a box of goods from a warehouse, he simply needs to hang up the packaging cases and the articles therein (they are usually in a horizontal state) sequentially by inserting a hanging hooks of a display shelf into the hanging holes of the packaging cases and turn them into a vertical state. Then, the articles will be vertically hung up and the inner cases will automatically slide out by gravity to a predetermined height in a tidy appearance. Thus, the packaging case can be operated rapidly and efficiently and the business cost will be reduced.

DETAILED DESCRIPTION OF THE PREFERRED EMBODIMENTS

The packaging case of the present invention comprises an inner case 3, an outer sleeve 4 and a strip 10.

Figure 1A:
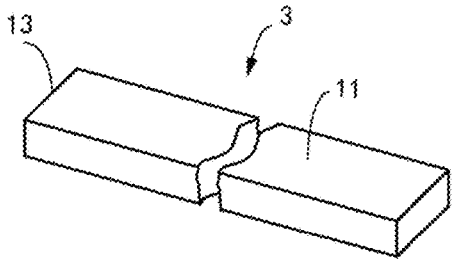
FIGS. 1A and 1B are schematic diagrams of an inner case of a packaging case according to the present invention.
Figure 1B:
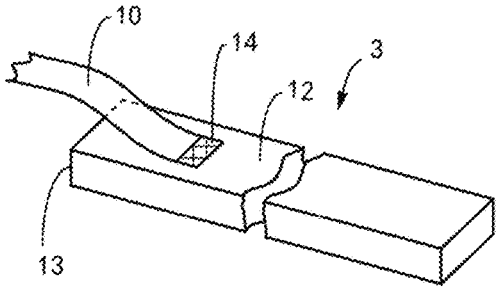

FIGS. 1A and 1B illustrate the inner case 3 of the packaging case according to the present invention. The inner case 3 as an example is usually a rectangular parallelepiped suitable for packing an elongated article. The inner case 3 has at least one top surface (front surface) 11 made of a transparent material (glass or transparent plastics, etc.) for the article packed in the inner case to be viewed. A reference numeral 13 denotes an upper end of the packaging case when it is in a vertically hung state. A reference numeral 12 denotes a bottom surface (made of a card board, for example) of the inner case 3. A reference numeral 10 denotes a strip for connecting the bottom surface 12 of the inner case 3 and an inner surface of a bottom panel 21 of the outer sleeve 4. A reference numeral 14 denotes one of both ends of the strip 10 which is connected to the bottom surface 12 of the inner case 3. The inner case 3 has two side surfaces and two end surfaces in addition to the front surface 11 and the bottom surface 12.

Figure 2:
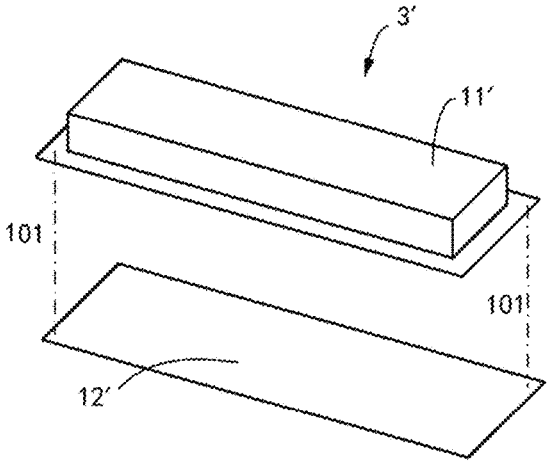
FIG. 2 is a schematic diagram of another type of structure of the inner case of the packaging case according to the present invention.

FIG. 2 illustrates an inner case 3' of the present invention, which is another example of the inner case. A reference numeral 11' denotes a front cover made of a plastic sheet by a suction-molding process. The front cover 11' has one top surface, two side surfaces and two end surfaces. A reference numeral 12' denotes a bottom plate (made of a card board, for example). As shown by dot dash lines 101, the article can be sealed inside the inner case 3' by stapling (or gluing, etc.) the front cover 11' onto the bottom plate 12'.

Figure 3:
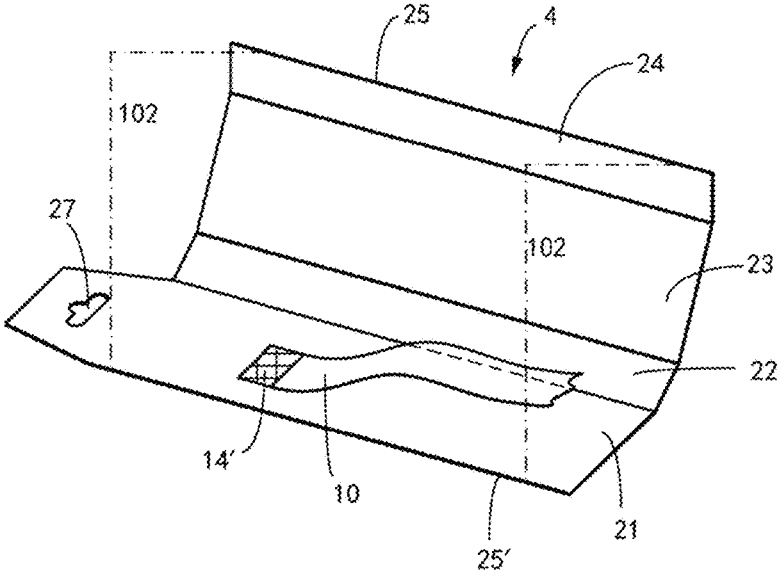
FIG. 3 is a schematic diagram showing an outer sleeve drawn in an unfolded manner of the packaging case according to the present invention.

FIG. 3 illustrates the outer sleeve 4 of the packaging case according to the present invention, which is folded by a piece of card board as an example. The outer sleeve 4 has a bottom panel 21, a top panel 23, a first side panel 22 and a second side panel 24. As illustrated by dot dash lines 102, the outer sleeve 4 will be formed (by gluing, etc.) when an edge 25 of the second side panel 24 is connected to an edge 25' of the bottom panel 21. Further, the other end 14' of the strip 10 is connected to the inner surface of the bottom panel 21 of the outer sleeve 4. It can be seen from FIG. 3 that after the outer sleeve 4 is formed, at least one of both ends in a longitudinal direction of the outer sleeve 4 (for example, a right-hand end of the outer sleeve 4) is opened as an entrance or exit for the inner case 3. A hanging hole 27 is provided on an end distant from the end which is opened of the outer sleeve 4, and the hanging hole 27 is used to hang the packaging case on a vertically displaying shelf in a shop or an exhibition hall.

Usually, the both ends of the strip 10 are fixed to the outer surface of the inner case 3 (or the inner surface of the outer sleeve 4) by adhesive bonding or molten plastics bonding, etc. The inner case 3 and the outer sleeve 4 can be made of a card board, a wood sheet, a plastic sheet, or a glass plate, etc. The strip 10 is made of a flexible thin sheet material, preferably, a plastic sheet.

Figure 4:
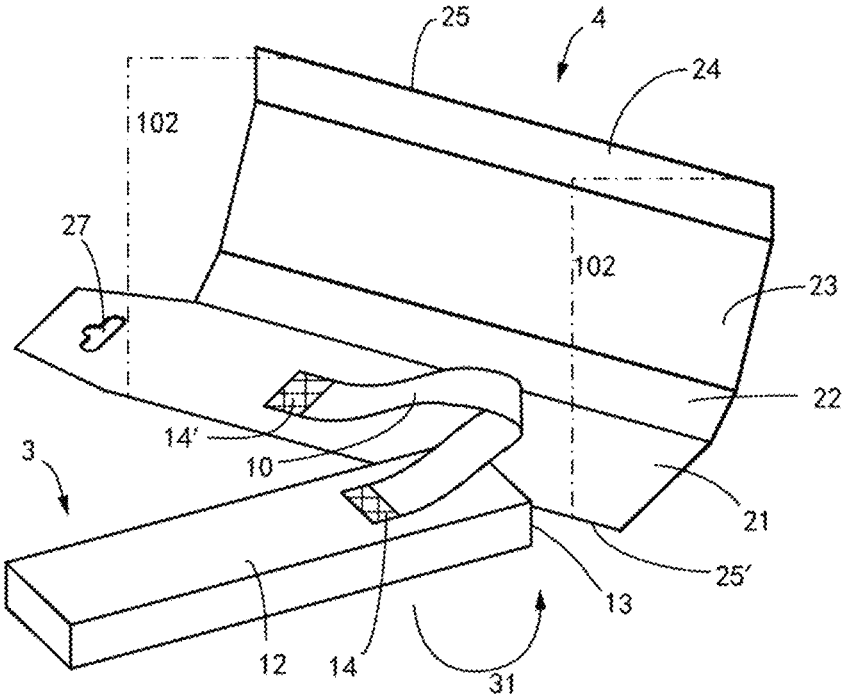
FIG. 4 is a schematic diagram showing how a strip is fixed to the inner case and the outer sleeve in an assembling process of the packaging case according to the present invention.

FIG. 4 is a schematic diagram of an assembling process for the inner case 3 and the outer sleeve 4 of the packaging case according to the present invention. The one end 14 of the strip 10 is bonded on the bottom surface 12 of the inner case 3, and the other end 14' of the strip 10 is bonded on the inner surface of the bottom panel 21 of the outer sleeve 4. According to the laying directions of the strip 10, the inner case 3 and the outer sleeve 4, the inner case 3 is turned over as shown by an arched arrow 31 and the bottom surface 12 of the inner case 3 is opposed to the bottom panel 21 of the outer sleeve 4. Then, other surfaces of the outer sleeve 4 are folded to bond the edge 25 of the second side panel 24 and the edge 25' of the bottom panel 21 as indicated by dot dash lines 102, and the outer sleeve 4 is closed.

Figure 5A:
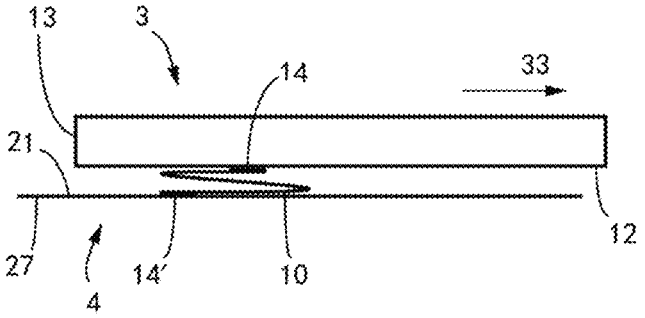
FIGS. 5A and 5B are schematic diagrams showing that the inner case is connected to the outer sleeve via the strip.
Figure 5B:
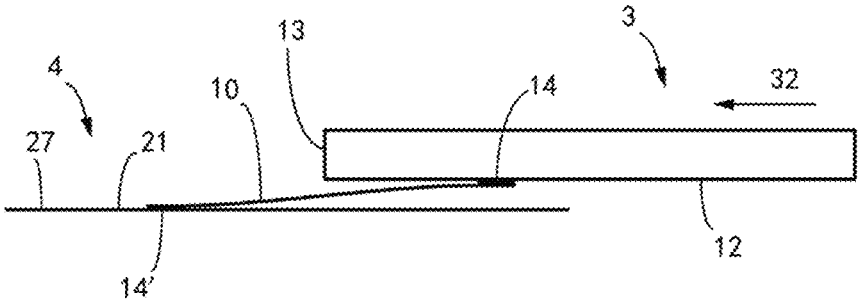

FIGS. 5A and 5B are schematic diagrams showing that the inner case 3 and the outer sleeve 4 of the packaging case according to the present invention are connected via the strip 10. For the sake of simplicity, only the connection between the bottom surface 12 of the inner case 3 and the bottom panel 21 of the outer sleeve 4 is shown. Further, a clearance between the bottom surface 12 and the bottom panel 21 is exaggeratedly drawn, but actually, the clearance can be very small. FIG. 5A shows a condition in which the inner case 3 is sheathed inside the outer sleeve 4, e.g. when the article is stored, warehoused or transported. At this time, the strip 10 is in a folded state in which the packaging case has a minimum length and a minimum volume. By pulling the inner case 3 out of the outer sleeve 4 in a direction shown by an arrow 33 (in actual use, a majority of the inner case 3 is pulled out of the outer sleeve 4), a condition as shown in FIG. 5B in which the majority of the inner case 3 is located outside the outer sleeve 4 is achieved. As shown in FIG. 5B, the strip 10 is pulled to be in a straight state and the inner case 3 is pulled out to an extreme. Actually, when the packaging case is vertically hung up to be displayed utilizing the hanging hole 27, the inner case 3 automatically slides out of the outer sleeve 4 due to gravity and the strip 10 is pulled straight to bear the weights of the article and the inner case 3. The inner case 3 can be pushed back into the outer sleeve 4 in a direction shown by an arrow 32.

Figure 6A:
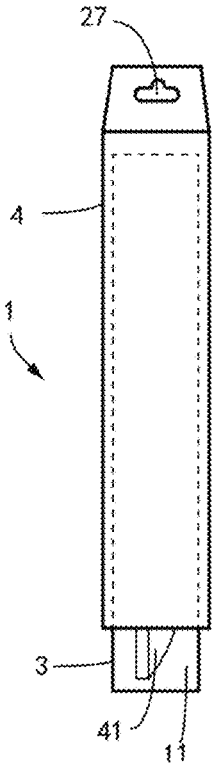
FIGS. 6A, 6B and 6C are schematic diagrams showing that the packaging cases according to the present invention are displayed in a shop or an exhibition hall.
Figure 6B:
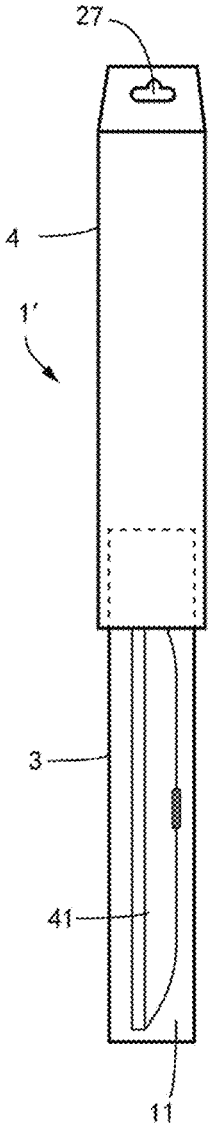
Figure 6C:
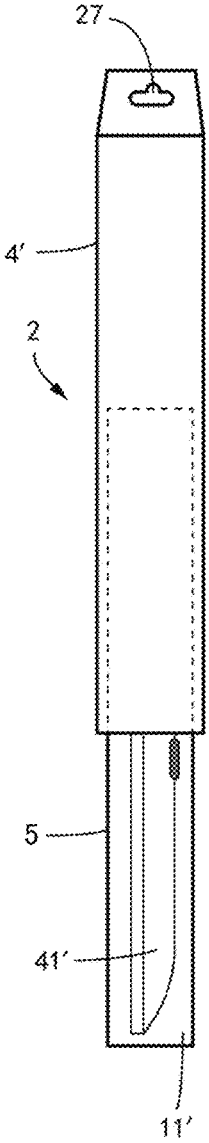

FIGS. 6A, 6B and 6C are schematic diagrams showing the conditions in which the packaging cases according to the present invention are displayed in a shop or an exhibition hall and in which the hanging holes 27 are used to vertically hang up the articles. FIG. 6A illustrates a condition in which the inner case 3 of the packaging case 1 has been pushed into the outer case 4 or a condition in which an article is just taken out from a warehouse and is vertically hung up (the articles are usually packed in a box in a horizontal state before being taken out). The article packed in the inner case 3 is, for example, preferably a wiper blade 41 for a windshield of a car and a fraction of the article can be viewed through the transparent surface 11 of the inner case 3. Alternatively, the inner case 3 may be entirely sheathed inside the outer sleeve 4 and can not be viewed. In FIG. 6B, when the packaging case 1 is vertically is hung, the inner case 3 together with the article 41 therein of the packaging case 1' slides out of the outer sleeve 4 to an extreme so that the strip 10 is pulled straight (the strip 10 is not drawn in FIG. 6B and it can be seen in FIG. 5B), the inner case 3 is largely exposed outside the outer sleeve 4, and a visitor can view the article packed in the inner case 3 through the transparent front surface 11. FIG. 6C illustrates a packaging case 2 packed with an article (a wiper blade 41' for the windshield of the car) having a different length which is vertically hung up and displayed. A length of strip 10 in a longitudinal direction of the packaging case can be adjusted. An overall length of the packaging case 2 as shown in FIG. 6C after the inner case 5 of the packaging case 2 is pulled out of the outer sleeve 4' to an extreme (i.e., the strip 10 is pulled straight) levels with an overall length of the packaging case 1' as shown in FIG. 6B after the inner case 3 of the packaging case 1' is pulled out of the outer case 4. This means that the lower ends of the packaging cases in FIGS. 6B and 6C will be at the same level. In this way, in case of the articles have different lengths, they can be hung up to be displayed in a shop or an exhibition hall in an orderly and aesthetic manner.

Moreover, in a shop or an exhibition hall, a worker simply needs to hang up the packaging cases and the articles therein (they are usually in a horizontal state) sequentially by utilizing the hanging holes 27 in the outer sleeves 4 and turn them into a vertical state after he takes out a box of goods from the warehouse. Then, the articles will be vertically hung up and the inner cases 3 or 5 will automatically slide out by gravity to a predetermined height in a tidy appearance. Thus, the packaging case can be operated rapidly and efficiently and the business cost will be reduced.

What is claimed is:

1. A packaging case comprising an inner case capable of accommodating an article and an outer sleeve with a shape matching that of the inner case and capable of externally sheathing the inner case, the inner case being able to move back and forth into and out of the outer sleeve, wherein said packaging case further comprises a strip made of a flexible thin sheet material, one end of the strip is fixed to an outer surface of the inner case, another end of the strip is fixed to an inner surface of the outer sleeve, and said outer surface of the inner case and said inner surface of the outer sleeve to which the strip is fixed are opposed to each other and in close proximity to each other when the inner case is sheathed in the outer sleeve and when the inner case moves back and forth into and out of the outer sleeve, wherein a hanging hole is provided on an end of the outer sleeve distant from the end which is opened, and wherein when the packaging case is vertically hung up utilizing the hanging hole, the inner case automatically slides out of the outer sleeve due to gravity.

2. The packaging case according to claim 1, wherein a length of the strip and positions of the outer surface and the inner surface to which both ends of the strip are fixed are arranged so that: (1) when the inner case is sheathed into the outer sleeve, the whole packaging case has a minimum overall length; and (2) when the inner case is pulled out of the outer sleeve to an extreme, a portion of the inner case is still sheathed by the outer sleeve.

3. The packaging case according to claim 2, wherein at least one of both ends in a longitudinal direction of the outer sleeve is opened.

4. The packaging case according to claim 2, wherein at least one surface of the inner case is made of a transparent material.

5. The packaging case according to claim 2, wherein the flexible thin sheet material of which the strip is made is a plastic sheet.

6. The packaging case according to claim 2, wherein both ends of the strip are fixed to the outer surface of the inner case and the inner surface of the outer sleeve by adhesive bonding or molten plastics bonding.

7. The packaging case according to claim 2, wherein the inner case and the outer sleeve are made of a card board, a wood sheet, a plastic sheet or a glass plate.

8. The packaging case according to claim 2, wherein the article to be packed in the packaging case is a wiper blade for a windshield of a car.

9. The packaging case according to claim 2, wherein the length of the strip in a longitudinal direction of the packaging case is adjustable.

* * * * *